US011753940B2

(12) United States Patent
Sasao et al.

(10) Patent No.: US 11,753,940 B2
(45) Date of Patent: Sep. 12, 2023

(54) STEAM TURBINE ROTOR BLADE

(71) Applicant: MITSUBISHI HEAVY INDUSTRIES, LTD., Tokyo (JP)

(72) Inventors: Yasuhiro Sasao, Tokyo (JP); Soichiro Tabata, Tokyo (JP); Ryo Takata, Tokyo (JP); Chongfei Duan, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/531,116

(22) Filed: Nov. 19, 2021

(65) Prior Publication Data

US 2022/0162947 A1 May 26, 2022

(30) Foreign Application Priority Data

Nov. 25, 2020 (JP) ..... 2020-195363

(51) Int. Cl.
*F01D 5/14* (2006.01)
*F01D 5/22* (2006.01)
*F01D 25/32* (2006.01)

(52) U.S. Cl.
CPC ..... *F01D 5/141* (2013.01); *F05D 2220/31* (2013.01); *F05D 2240/30* (2013.01)

(58) Field of Classification Search
CPC ..... F05D 2220/31; F05D 2240/30; F05D 2240/303; F05D 2240/307;
(Continued)

(56) References Cited

U.S. PATENT DOCUMENTS 4,342,542 A * 8/1982 Tan ..... F01D 5/14 416/224
4,795,313 A * 1/1989 Coulon ..... F01D 5/28 228/262.72

(Continued)

FOREIGN PATENT DOCUMENTS

JP S36-18252 B 10/1961
JP 2002-266602 A 9/2002

(Continued)

OTHER PUBLICATIONS

Machine Translation of JP 2002266602A [retrieved on Jan. 31, 2023]. Retrieved from: Espacenet. (Year: 2023).*

(Continued)

*Primary Examiner* — Eric J Zamora Alvarez
(74) *Attorney, Agent, or Firm* — WHDA, LLP

(57) ABSTRACT

Provided is a steam turbine rotor blade having, at an intermediate position in a blade length direction thereof, a tie boss for connection to an adjacent blade, wherein the steam turbine rotor blade includes a leading edge side protrusion that is extending in an embankment shape in a blade chord length direction at an intermediate position in the blade length direction, a start end and a terminal end of the leading edge side protrusion are located on a suction side surface and a pressure side surface, respectively, and the leading edge side protrusion continues from the start end to the terminal end via a blade leading edge and arrangement thereof in the blade length direction overlaps with the tie boss as viewed from the upstream side.

4 Claims, 7 Drawing Sheets

(58) Field of Classification Search
CPC ..... F05D 2240/123; F05D 2260/96; F05D 2260/602; F05D 2240/122; F05D 2260/95; F05D 2230/10; F05D 2300/51; F05D 2300/603; F05D 2240/121; F05D 2240/124; F05D 2240/304; F05D 2240/306; F05D 2240/305; F05D 2250/182; F05D 2250/294; F05D 2240/12; F05D 2250/12; F05D 2250/11; F05D 2250/13; F05D 2240/80; F05D 2250/61; F05D 2240/126; F05D 2240/125; F05D 2240/127; F01D 5/147; F01D 5/225; F01D 9/041; F01D 25/32; F01D 5/141; F01D 5/22; F01D 5/16; F01D 5/286; F01D 5/14; F01D 5/26; F01D 5/143; F01D 5/146; F04D 29/324; F04D 29/326; F04D 29/388; F04D 29/668; B23P 15/02; B24C 1/10
See application file for complete search history.

(56) References Cited

U.S. PATENT DOCUMENTS

2010/0028160 A1* 2/2010 Schaeffer ..... F04D 29/324 29/889.71
2011/0158810 A1 6/2011 Shibukawa et al.
2019/0101000 A1* 4/2019 Danno ..... F01D 5/14

FOREIGN PATENT DOCUMENTS

| | | | |
|---|---|---|---|
| JP | 2002-295201 | A | 10/2002 |
| JP | 2011-137424 | A | 7/2011 |
| JP | 2016-166569 | A | 9/2016 |
| JP | 2017-218983 | A | 12/2017 |

OTHER PUBLICATIONS

Machine Translation of JP 2017218983A [retrieved on Jan. 31, 2023]. Retrieved from: Espacenet. (Year: 2023).*
Office Action dated Jun. 16, 2022, issued in counterpart IN Application No. 202114052358, with English Translation. (5 pages).
Office Action dated Dec. 13, 2022, issued in counterpart JP Application No. 2020-195363, with English Translation. (8 pages).

* cited by examiner

STEAM TURBINE ROTOR BLADE

BACKGROUND OF THE INVENTION

1. Field of the Invention

The present invention relates to a steam turbine rotor blade.

2. Description of the Related Art

In a steam turbine, in a process of conversion of energy of steam flowing from a high pressure stage to a low pressure stage into mechanical work, the steam temperature decreases and part of the steam is condensed to generate fine water droplets. Therefore, in the steam that drives the steam turbine, not only the gas phase but also the liquid phase, namely, fine water droplets, exist, and fine water droplets accompanying the gas phase increase in the amount toward the lower pressure stage. At a low pressure stage, fine water droplets are captured by the blade surface of a stator blade, and such fine water droplets are transferred by the drag of the gas phase and, in a process in which they are moved to the downstream side on the blade surface, absorb each other to be coarsened. Then, the fine water droplets captured by the surfaces of stator blade form water films, water rivulets or coarse water droplet, and reach a trailing edge of the blade. In the description, these three states of the water film formation, namely "water film", "water rivulet" and "coarse water droplet" are collectively described as "coarse water droplet" unless otherwise specified. The water droplets are entrained by the gas phase again as coarse water droplets. Part of the water droplets having been released from the stator blade are captured by the blade surface of a rotor blade on the downstream side. The water droplets being captured by the blade surface of the rotor blade get kinetic energy in a process of being moved, due to centrifugal force caused by rotation of the rotor blade, toward the blade distal end side on the blade surface, and deteriorate the turbine efficiency or are scattered to cause erosion.

In this connection, a configuration is disclosed in JP-2016-166569-A, in which a rib extending from the proximity of a leading edge to the proximity of the trailing edge is provided on each the suction side surface and the pressure side surface of a rotor blade such that water droplets that are moved to the blade distal end side on the rotor blade surface are guided to the blade trailing edge side by the ribs.

Patent document 1: JP-2016-166569-A

In a case where a rib is provided on the blade surface of a rotor blade in such a manner as disclosed in JP-2016-166569-A, the rib serves as a weight and changes the weight and the weight distribution of the rotor blade. In recent years, since the speed of rotation of a steam turbine has been speeded up, the design of a rotor blade especially having a great blade length has become severe, and in fact, there is little room in design for permitting increase in the weight of a rotor blade or a change in the weight distribution of a rotor blade. Further, the rib projecting from the blade surface also makes a factor of deterioration of the aerodynamic performance of the rotor blade.

It is an object of the present invention to provide a steam turbine rotor blade that allows water droplets being moved on a rotor blade surface to be released from the blade surface to improve the turbine efficiency while suppressing an influence on the aerodynamic performance of the rotor blade.

SUMMARY OF THE INVENTION

In order to achieve the object described above, according to the present invention, there is provided a steam turbine rotor blade having, at an intermediate position in a blade length direction thereof, a tie boss for connection to an adjacent blade, wherein the steam turbine rotor blade includes a leading edge side protrusion that extends in an embankment shape in a blade chord length direction at an intermediate position in the blade length direction; a start end of the leading edge side protrusion is located on a suction side surface and a terminal end of the leading edge side protrusion is located on a pressure side surface; and the leading edge side protrusion continues from the start end to the terminal end via a blade leading edge and arrangement thereof in the blade length direction overlaps with the tie boss as viewed from an upstream side.

According to the present invention, water droplets being moved on the rotor blade surface can be released from the blade surface to improve the turbine efficiency while the influence on the aerodynamic performance of the rotor blade is suppressed.

DESCRIPTION OF THE PREFERRED EMBODIMENTS

In the following, an embodiment of the present invention is described with reference to the drawings.

Steam Turbine Power Generation Equipment

Figure 1:
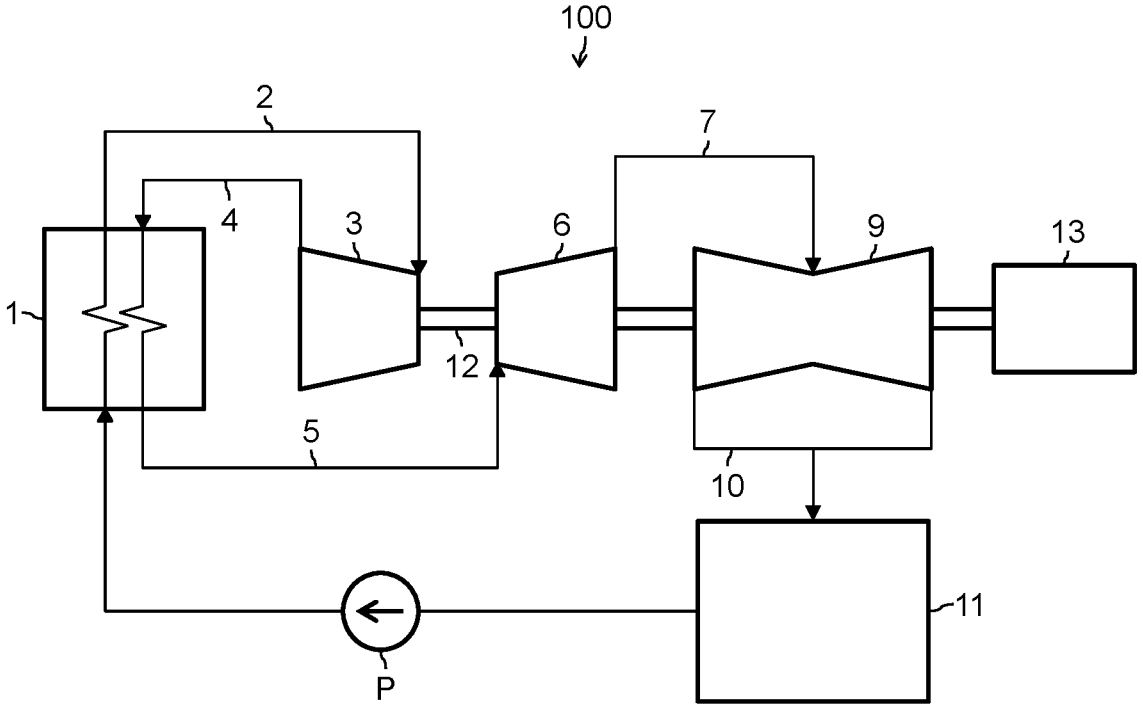
FIG. 1 is a view schematically depicting an example of steam turbine equipment in which a steam turbine rotor blade according to an embodiment of the present invention is used.

FIG. 1 is a view schematically depicting an example of steam turbine equipment in which a steam turbine rotor blade according to an embodiment of the present invention is used. Referring to FIG. 1, steam turbine power generation equipment 100 depicted includes a steam generation source 1, a high-pressure turbine 3, a mid-pressure turbine 6, a low-pressure turbine 9, a condenser 11 and a load apparatus 13.

The steam generation source 1 is a boiler and heats water supplied thereto from the condenser 11 to generate steam of a high temperature and a high pressure. The steam generated by the steam generation source 1 is introduced into the high-pressure turbine 3 through a main steam pipe 2 to drive the high-pressure turbine 3. The steam decreased in temperature and reduced in pressure by driving the high-pressure turbine 3 is introduced through a high-pressure turbine exhaust pipe 4 into the steam generation source 1, by which it is heated again to form reheated steam.

The reheated steam generated by the steam generation source 1 is introduced into the mid-pressure turbine 6 through a reheated steam pipe 5 to drive the mid-pressure turbine 6. The steam decreased in temperature and reduced in pressure by driving the mid-pressure turbine 6 is introduced into the low-pressure turbine 9 through a mid-pressure turbine exhaust pipe 7 to drive the low-pressure turbine 9. The steam further decreased in temperature and reduced in pressure by driving the low-pressure turbine 9 is introduced into the condenser 11 through a diffuser. The condenser 11 includes a cooling water piping (not depicted) and condense the steam by heat exchange between the steam introduced into the condenser 11 and cooling water flowing in the cooling water piping. The water condensed by the condenser 11 is fed to the steam generation source 1 again by a feed water pump P.

Turbine rotors 12 of the high-pressure turbine 3, mid-pressure turbine 6 and low-pressure turbine 9 are connected coaxially to each other. The load apparatus 13 representatively is a generator and is connected to the turbine rotors 12 and driven by rotational output power of the high-pressure turbine 3, mid-pressure turbine 6, and low-pressure turbine 9.

It is to be noted that, for the load apparatus 13, a pump is sometimes adopted in place of the generator. Further, although the configuration including the high-pressure turbine 3, mid-pressure turbine 6, and low-pressure turbine 9 is exemplified, the configuration may otherwise omit, for example, the mid-pressure turbine 6. Further, although the configuration in which the high-pressure turbine 3, mid-pressure turbine 6, and low-pressure turbine 9 drive the same load apparatus 13 is exemplified, the configuration may otherwise be provided such that the high-pressure turbine 3, mid-pressure turbine 6, and low-pressure turbine 9 drive load apparatuses different from each other. Further, the configuration may be modified such that the high-pressure turbine 3, mid-pressure turbine 6, and low-pressure turbine 9 are grouped into two groups (namely, a group of two turbines and another group of the remaining one turbine) and one load apparatus is driven by each of the groups. Furthermore, although the configuration that includes a boiler as the steam generation source 1 is exemplified, it may be modified such that a heat recovery steam generator (HRSG) that utilizes waste heat of a gas turbine is adopted as the steam generation source 1. In short, a steam turbine rotor blade hereinafter described can be used also in combined cycle power generation equipment. The steam turbine rotor blade hereinafter described can be applied also to a steam turbine used for geothermal power generation and nuclear power generation.

Steam Turbine

Figure 2:
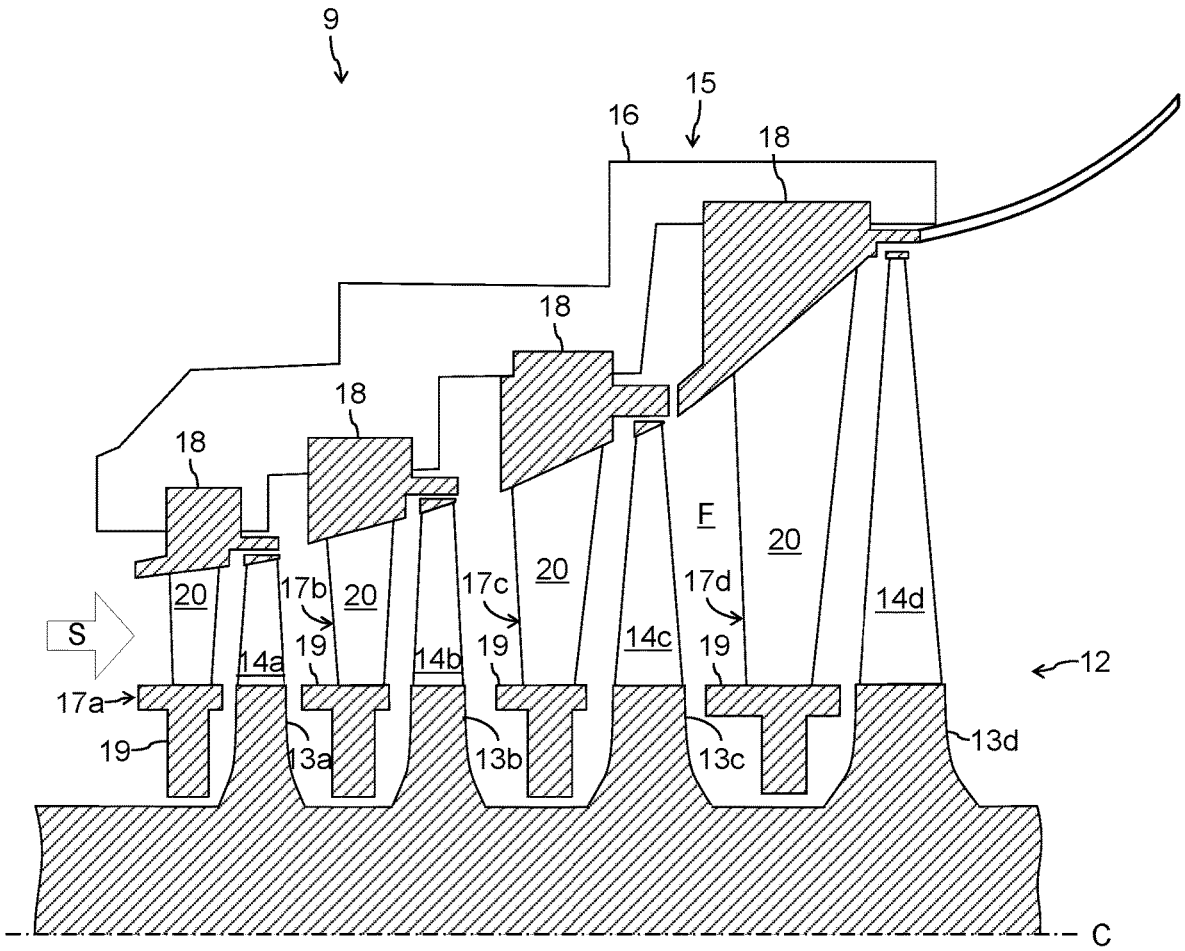
FIG. 2 is a cross sectional view of a steam turbine in which the steam turbine rotor blade according to the embodiment of the present invention is used, the cross section being taken along a plane that passes through a rotation center line of a turbine rotor.

FIG. 2 is a cross sectional view of the low-pressure turbine 9 taken along a plane passing through the rotation center line of the turbine rotor 12, namely, along a medieval plane. As depicted in FIG. 2, the low-pressure turbine 9 includes the turbine rotor 12 and a stator 15 that covers the turbine rotor 12. A diffuser is arranged at the exit of the stator 15. It is to be noted that, in the present specification, the direction of rotation of the turbine rotor 12 is defined as "circumferential direction," the direction in which the rotation center line C of the turbine rotor 12 extends is defined as "axial direction," and a radial direction of the turbine rotor 12 is defined as "radial direction."

The turbine rotor 12 includes rotor disks 13*a* to 13*d* and rotor blades 14*a* to 14*d*. The rotor disks 13*a* to 13*d* are disk-shaped members and are arranged in a stacked state in the axial direction. The rotor disks 13*a* to 13*d* are sometimes arranged in a stacked state with spacers alternately interposed therebetween. A plurality of such rotor blades 14*d* are provided at regular intervals in the circumferential direction on an outer circumferential surface of the rotor disk 13*d*. Similarly, a plurality of rotor blades 14*a* to 14*c* are provided at regular intervals on an outer circumferential surface of the rotor disks 13*a* to 13*c*, respectively. Each of the rotor blades 14*a* to 14*d* extends to the outer side in the radial direction from the outer circumferential surface of each of the rotor disks 13*a* to 13*d* and faces a tubular working fluid flow path F. Energy of steam S flowing in the working fluid flow path F is converted into mechanical work by the rotor blades 14*a* to 14*d*, and the turbine rotor 12 is rotated integrally around the rotation center line C.

The stator 15 includes a casing 16 and diaphragms 17*a* to 17*d*. The casing 16 is a tubular member that forms an outer circumferential wall of the low-pressure turbine 9. The diaphragms 17*a* to 17*d* are attached to an inner circumferential portion of the casing 16. The diaphragms 17*a* to 17*d* are segments that configure cascades of stator blades and are each formed integrally including a diaphragm outer ring 18, a diaphragm inner ring 19, and a plurality of stator blades 20. A plurality of the diaphragms 17*a* to 17*d* are arranged individually in the circumferential direction to form a ring shape and configure cascades of the stator blades 20 of a plurality of stages (in FIG. 4, four stages).

The diaphragm outer ring 18 is a member having an inner circumferential surface that defines the outer circumference of the working fluid flow path F, and is supported on the inner circumferential surface of the casing 16. A plurality of such diaphragm outer rings 18 are arranged in the circumferential direction to form a ring. In the present embodiment, the inner circumferential surface of the diaphragm outer ring 18 is inclined to the outer side in the radial direction toward the downstream side (rightward in FIG. 2). The diaphragm inner ring 19 is a member having an outer circumferential surface that defines the inner circumference of the working fluid flow path F, and is arranged on the inner side in the radial direction with respect to the diaphragm outer ring 18. A plurality of such diaphragm inner rings 19 are arranged in the circumferential direction to form a ring. A plurality of the stator blades 20 are arranged in a lined up relation in the circumferential direction at each stage and extend in the radial direction to connect the diaphragm inner rings 19 and the diaphragm outer rings 18 to each other.

It is to be noted that one stage is configured from a stator blade 20 and a rotor blade adjacent, on the downstream side, to the stator blade 20. In the present embodiment, the stator blade 20 of the diaphragm 17*a* and the rotor blade 14*a* configure a first stage. Similarly, the stator blade 20 of the diaphragm 17*b* and the rotor blade 14*b* configure a second state; the stator blade 20 of the diaphragm 17*c* and the rotor blade 14*c* configure a third stage; and the stator blade 20 of the diaphragm 17*d* and the rotor blade 14*d* configure a fourth stage (last stage).

Steam Turbine Rotor Blade

Figure 3:
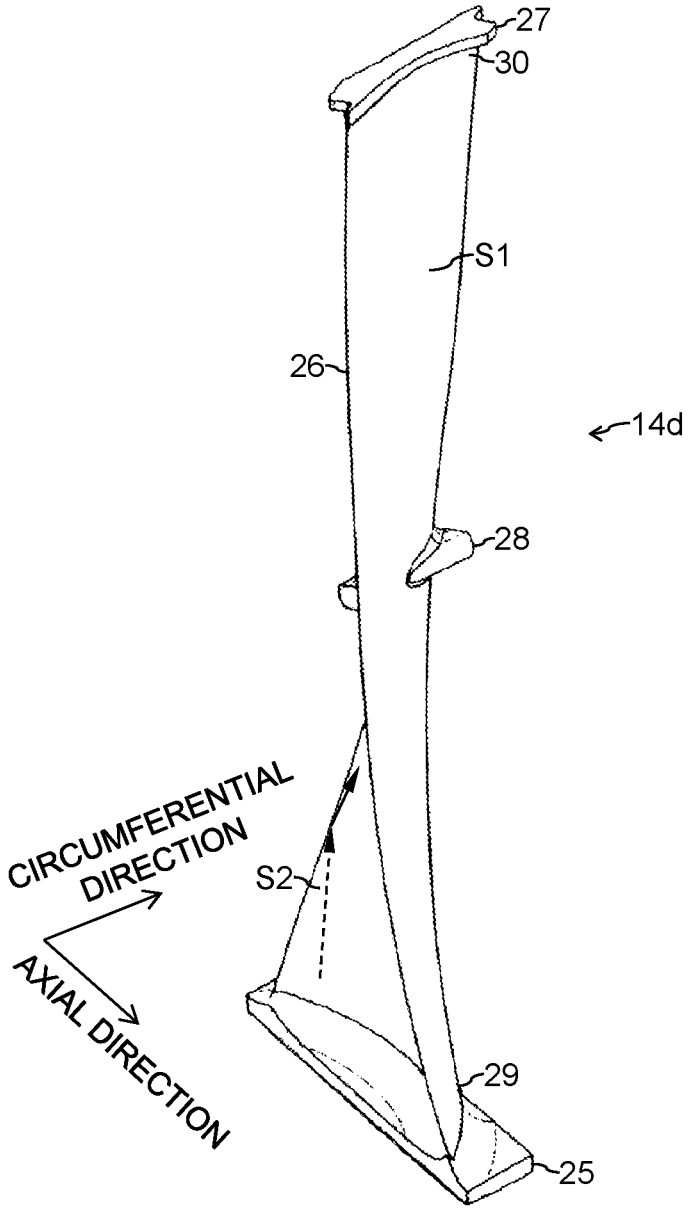
FIG. 3 is a perspective view depicting an appearance configuration of the steam turbine rotor blade according to the embodiment of the present invention.
Figure 4:
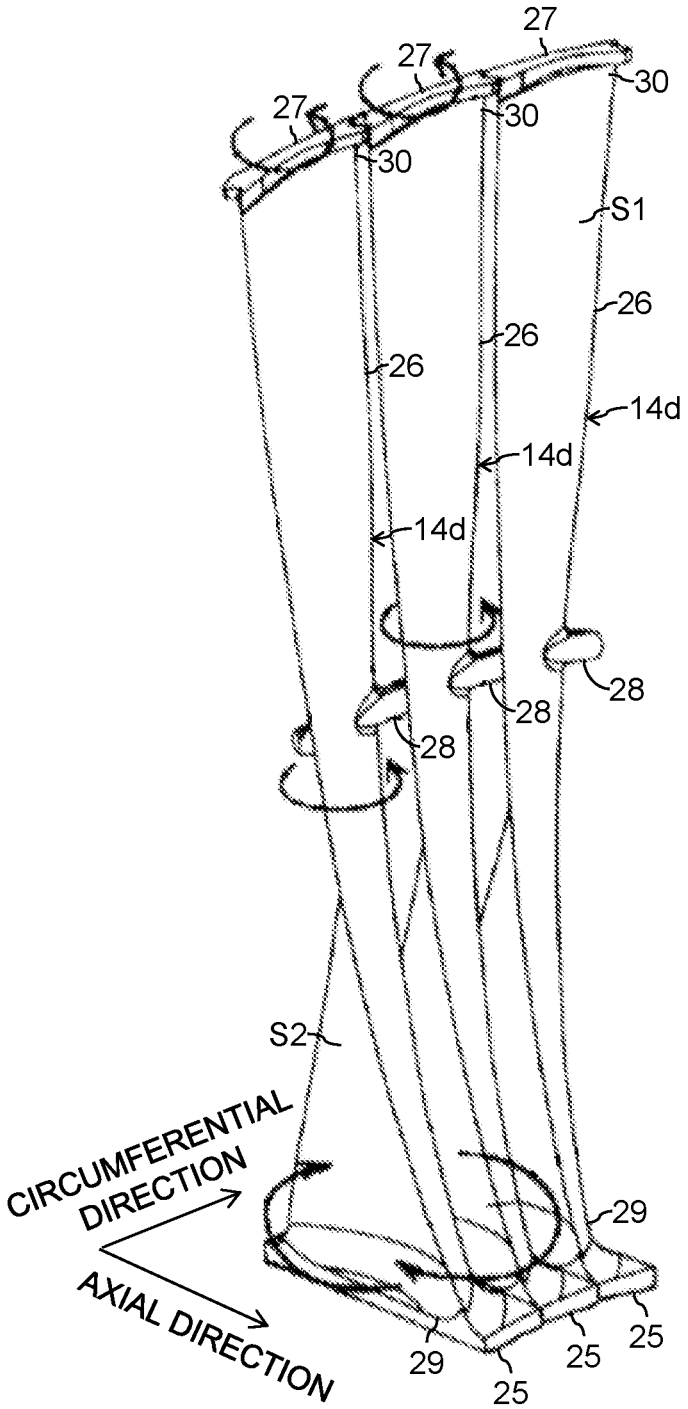
FIG. 4 is a perspective view depicting extracted part of a cascade of blades configured from the steam turbine rotor blade according to the embodiment of the present invention.

FIG. 3 is a perspective view depicting an appearance configuration of a single rotor blade, and FIG. 4 is a perspective view depicting part extracted from a cascade of blades configured from a plurality of rotor blades. The rotor blade depicted in FIGS. 3 and 4 is referred to as long blade, and rotor blades of a similar configuration can be used at the last stage or a plurality of last stages of the low-pressure turbine 9. In regard to long blades in recent years, the blade distal end peripheral speed Mach number frequently exceeds 1.0. Although the rotor blade depicted in FIGS. 3 and 4 is described as the rotor blade 14*d* of the last stage, the long blades used at the other stages have a similar configuration.

The rotor blade 14*d* depicted in FIGS. 3 and 4 includes a platform 25, a blade profile portion (profile portion) 26, an integral cover 27, and a tie boss 28.

The platform 25 supports a root portion 29 (portion on the inner side in the radial direction) of the blade profile portion 26 and has an implantation portion (not depicted) projecting to the opposite side to the blade profile portion 26 (i.e., to the inner side in the radial direction). By fitting the implantation portion into a groove (not depicted) formed on the outer circumferential surface of the rotor disk 13*d* (FIG. 2), the rotor blade 14*d* is fixed to the rotor disk 13*d*.

The blade profile portion 26 is a portion for converting energy of steam into mechanical work and extends to the outer side in the radial direction from the outer circumferential surface of the platform 25. Although the blade profile portion 26 is twisted, in the present embodiment, in the clockwise direction as viewed from the outer side in the radial direction, it is sometimes configured so as to be twisted in the reverse direction.

The integral cover 27 is one of connection portions between rotor blades 14*d* adjacent to each other in the circumferential direction and is provided at a distal end portion 30 of the blade profile portion 26 (at an end portion on the outer side in the radial direction). A surface of the integral cover 27 directed to the inner side in the radial direction defines the outer circumference of the working fluid flow path F. If the rotor blades 14*d* are rotated, then since the blade profile portions 26 are twisted, due to centrifugal force, in a direction in which the twist thereof is untwisted, the integral covers 27 of the rotor blades 14*d* adjacent to each other in the circumferential direction are brought into contact with each other by the twisting back of the blade profile portion 26, and consequently, the blades adjacent to each other are connected to each other (FIG. 4).

The tie boss 28 is one of connection portions between rotor blades 14*d* adjacent to each other in the circumferential direction, and is provided between the root portion 29 and the distal end portion 30 of the blade profile portion 26, in the present embodiment, at an intermediate portion of the blade profile portion 26 in the blade length direction (radial direction). The tie boss 28 is provided so as to project from both the suction side face S1 and the pressure side face S2 of the rotor blade 14*d*. Similarly to the integral cover 27, when the rotor blades 14*d* are rotated, the tie bosses 28 on the suction side and the pressure side of the rotor blades 14*d* adjacent to each other in the circumferential direction are brought into contact with each other by twisting back of the blade profile portion 26, whereby the blades adjacent to each other are connected to each other (FIG. 4). Although, in FIGS. 3 and 4, a case is exemplified in which the tie boss 28 is provided at a middle portion of the blade profile portion 26 in the blade length direction, the position of the tie boss 28 in the blade length direction can be changed in response to the torsional rigidity or the like of the blade profile portion 26.

Blade Profile

Figure 5:
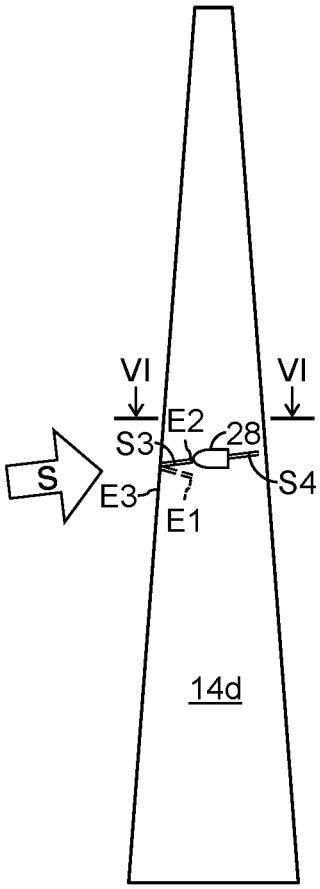
FIG. 5 is a schematic view depicting a blade profile portion of the rotor blade at the last stage in FIG. 2.
Figure 6:
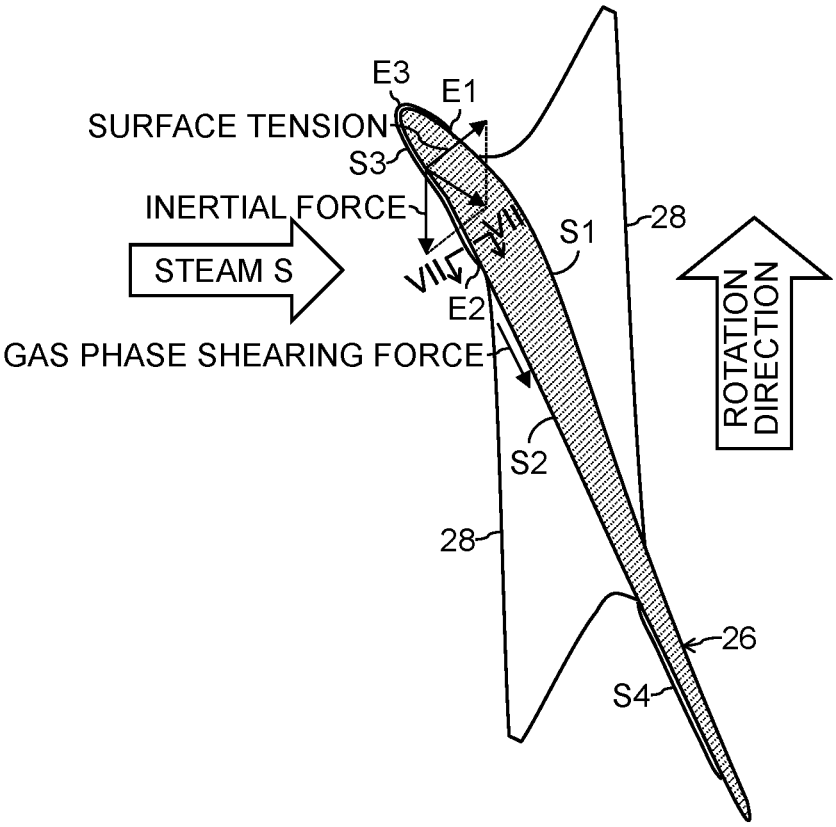
FIG. 6 is a cross sectional view of the rotor blade taken along line VI-VI in FIG. 5.
Figure 7:
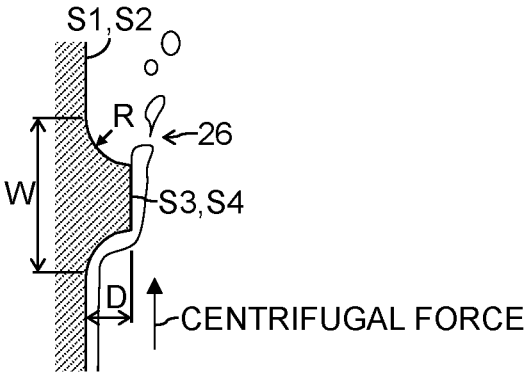
FIG. 7 is a cross sectional view of a protrusion taken along line VII-VII in FIG. 6.

FIG. 5 is a schematic view of the blade profile portion of the rotor blade at the last stage in FIG. 2; FIG. 6 is a sectional view (blade profile) of the rotor blade taken along line VI-VI in FIG. 5; and FIG. 7 is a cross sectional view of a protrusion taken along line VII-VII in FIG. 6. Although the rotor blade 14*d* is indicated as a representative in FIGS. 5 to 7, where a long blade is used also at a stage other than the last stage, a similar configuration is applied not only to the rotor blade 14*d* at the last stage but also to rotor blades (long blades) at a plurality of last stages.

The rotor blades 14*a* to 14*d* are produced with a high degree of accuracy by machining a material (not depicted) which is obtained by press work or casting. Accordingly, for a blade profile portion of the material, a machining allowance of several mm is assured over an overall surface. In the present embodiment, the rotor blade 14*d* at the last stage or the rotor blades (long blades) at a plurality of last stages have a blade profile in which the blade surface partly protrudes (projects) as viewed in a cross section taken along a plane orthogonal to the rotation center line C of the turbine rotor 12 as depicted in FIG. 7. In the following description, the partially protruding blade surface is referred to as leading edge side protrusion S3. The rotor blade 14*d* has such a blade profile that it incorporates the leading edge side protrusion S3, or in other words, such a blade profile that the curvature of the blade surface is partly changed (or inflected) in relation to the position in the blade length direction to form the leading edge side protrusion S3.

The blade profile portion of the rotor blade 14*d* is carved out from the material by machining the machining allowance including the leading edge side protrusion S3. In particular, the projection amount of the leading edge side protrusion S3 from the suction side face S1 or the pressure side face S2 is limited equal to or less than the machining allowance of the material, for example, approximately 2 mm. In other words, the leading edge side protrusion S3 is designed within the range of profile adjustment of the blade profile. The suction side face S1 and the pressure side face S2 except the leading edge side protrusion S3 (in the following description, where the term suction side face S1 or pressure side face S2 is used, this signifies a blade surface excluding the protrusion) is designed emphasizing the aerodynamic performance while the balance between the strength of the rotor blade and the mass distribution is taken into consideration. In contrast, the leading edge side protrusion S3 (similarly, a trailing edge side protrusion S4 hereinafter described) is designed taking the balance of the strength, mass distribution, and aerodynamic performance into consideration while the draining function for draining water droplets on the blade surface is assured.

As depicted in FIG. 5, the leading edge side protrusion S3 extends in an embankment-like pattern in the chord length direction of the rotor blade. As depicted in FIG. 6, a start end E1 of the leading edge side protrusion S3 is positioned on the suction side face S1 of the rotor blade, and a terminal end E2 of the leading edge side protrusion S3 is positioned on the pressure side face S2 of the rotor blade. In the present example, the start end E1 on the leading edge side protrusion S3 is positioned on the leading edge side with respect to the tie boss 28 on the suction side face S1. The terminal end E2 on the leading edge side protrusion S3 contacts or is positioned closely to a front portion of the tie boss 28. The leading edge side protrusion S3 continues from the start end El to the terminal end E2 via a blade leading edge E3 of the rotor blade.

Further, as depicted in FIG. 5, the leading edge side protrusion S3 is positioned at an intermediate position of the rotor blade in the blade length direction (upward and downward directions in FIG. 5). As depicted in FIG. 5, the width W (FIG. 7) of the leading edge side protrusion S3 taken in the blade length direction is smaller than the width of the tie boss 28 taken in the same direction and, as viewed from the upstream side in the flowing direction of the steam S, the arrangement of the leading edge side protrusion S3 in the blade length direction overlaps, at least in part (preferably the entirety) thereof, with the tie bosses 28. Further, the leading edge side protrusion S3 extends such that the distance thereof from the blade root (in other words, the rotor disk 13*d* (FIG. 2)) increases monotonously from the start end E1 to the terminal end E2 as depicted in FIG. 5, and is, in the present embodiment, inclined uniformly with respect to the rotation center line C. Accordingly, on the suction side of the rotor blade, the leading edge side protrusion S3 is inclined to the outer side in the radial direction toward the leading edge (broken line in FIG. 5), and on the pressure side of the rotor blade, the leading edge side protrusion S3 is inclined to the outer side in the radial direction toward the trailing edge (solid line in FIG. 5).

It is to be noted that, although the flowing direction of the steam S is a direction substantially along the rotation center line C, in relation to the rotor blade, it strictly is a direction from the blade leading edge to the blade trailing edge along the blade surface and is inclined to the blade distal end side toward the blade trailing edge.

Further, as depicted in FIG. 7, the leading edge side protrusion S3 is thin such that the thickness D thereof taken in a normal direction to the blade surface (suction side face S1 or pressure side face S2) is further smaller than the width W of the leading edge side protrusion S3. The thickness D is sufficient even if it is small, and where the aspect ratio to the width W of the leading edge side protrusion S3 is defined as W/D, the cross sectional shape of the leading edge side protrusion S3 can be set, for example, within a range of $W/D>2$, realistically within a range of $2<W/D<100$. As an example, the width W can be made approximately 4 mm, and the thickness D can be made approximately 2 mm.

In the present embodiment, the leading edge side protrusion S3 is formed so as to have a trapezoidal cross sectional shape for its ease of processing. The opposite end portions (upper and lower end portions in FIG. 7) of an upper side portion (surface parallel to the pressure side face S2 in FIG. 7) of the trapezoidal cross sectional shape of the leading edge side protrusion S3 form sharp edges. The oblique portions of the trapezoidal cross sectional shape of the leading edge side protrusion S3 (surfaces connecting an upper side portion of the leading edge side protrusion S3 to the pressure side face S2 in FIG. 7) form fillets of a radius R of curvature, and the oblique portions of the leading edge side protrusion S3 connect smoothly to the blade surface (in FIG. 7, to the pressure side face S2).

Further, in the present embodiment, a trailing edge side protrusion S4 is provided also on the trailing edge side with respect to the tie boss 28 on the pressure side of the rotor blade. The trailing edge side protrusion S4 has a cross sectional shape and a cross sectional area similar to those of the leading edge side protrusion S3 and is positioned on an extension of the leading edge side protrusion S3 in a trailing edge side region of the pressure side face S2. The trailing edge side protrusion S4 extends such that the tie boss 28 is interposed between the trailing edge side protrusion S4 and the leading edge side protrusion S3. If the trailing edge side protrusion S4 is viewed from the upstream side in the flowing direction of the steam S, then at least part (preferably the entirety) of it overlaps with the tie boss 28 and at least part (preferably the entirety) of it is hidden by the tie boss 28. The start end of the trailing edge side protrusion S4 (end portion on the blade leading edge side) contacts or is positioned closely to the tie boss 28, and the terminal end of the trailing edge side protrusion S4 (end portion on the blade trailing edge side) is spaced by a fixed distance from the trailing edge of the rotor blade.

In this manner, in the present embodiment, the range in which a protrusion is formed on the blade surface of the rotor blade as viewed in the radial direction is only a formation region of the leading edge side protrusion S3 and the trailing edge side protrusion S4. The protrusion does not exist in any of the provision region of the tie boss 28 on the suction side face S1 and the pressure side face S2, a region in the proximity of the trailing edge of the pressure side face S2, and a region on the trailing edge side of the suction side face S1 with respect to the tie boss 28, as viewed in the radial direction as depicted in FIG. 6. The leading edge side protrusion S3 and the trailing edge side protrusion S4 are provided on the suction side face S1 and the pressure side face S2 avoiding the three regions around the rotor blade as viewed in the radial direction.

Manufacture of Steam Turbine Rotor Blade

As described hereinabove, the rotor blade 14*d* at the last stage or the rotor blades at a plurality of last stages are shaped by carving out by machining (for example, end milling) a material which is shaped by press work or casting. At the same machining step, the suction side face S1, pressure side face S2, leading edge side protrusion S3, and trailing edge side protrusion S4 are formed altogether. Then, shot peening is performed for at least the blade profile portion of the rotor blade having been carved out by machining to harden the surface of the rotor blade and provide compressive residual stress thereby to improve the fatigue strength, abrasion resistance, and stress corrosion cracking resistance.

Behavior of Water Droplet

Description is given taking the last stage of the low-pressure turbine 9 as an example. Part of coarse water droplets having been grown on the blade surface of the stator blade 20 at the last stage and released from the stator blade 20 are captured by a portion in the proximity of a leading edge of the suction side face S1 of the rotor blade 14*d*. Separately from such coarse water droplets, part of fine water droplets having accompanied the gas phase and passed between adjacent static blades, without being captured by the static blades, inertially collide with and are captured by the suction side face S1 and the pressure side face S2 of the rotor blade 14*d*. Since the rotor blade 14*d* that is a long blade has a twisted shape as depicted in FIG. 3, when a water droplet being captured by the suction side face S1 at a portion rather near to the root in the blade length direction is moved, by centrifugal force, in the direction toward the blade distal end, it passes through the leading edge and goes around to the pressure side face S2. In FIG. 3, the behavior of a water droplet being captured by the suction side face S1 is exemplified by a broken line arrow mark and the behavior of the water droplet after going around to the pressure side face S2 is exemplified by a solid line arrow mark.

Although the water droplets being captured by the pressure side face S2 and including water droplets having gone around to the pressure side in this manner stick to the pressure side face S2 by blowing of the gas phase of the steam S and the surface tension, the inertial force accompanying rotation of the turbine rotor 12 acts in a direction in which the water droplets are released from the pressure side face S2. Therefore, during a period of time in which the water droplets being captured by the pressure side face S2 are moved, by the centrifugal force, in the direction toward the blade distal end, they are in an unstable state due to the force acting to keep them on the blade surface and the force acting to peel off them.

In a process in which water droplets being moved on the blade surface on the root side with respect to the tie boss 28 are moved to the blade distal end side by the centrifugal force, they are accelerated and reach the leading edge side protrusion S3 or the trailing edge side protrusion S4 on the suction side or the pressure side. Those water droplets ride vigorously on the leading edge side protrusion S3 or the trailing edge side protrusion S4 and are released from the blade surface without reaching the blade distal end by a draining effect (FIG. 7). Especially, on the pressure side of the blade, since water droplets are captured in an unstable state to the blade surface as described hereinabove, they are released from the blade surface easily with the momentum with which they ride on the leading edge side protrusion S3 or the trailing edge side protrusion S4. On the pressure side, although the gas phase of the steam S acts in a direction in which it presses water droplets against the pressure side face S2, since the water droplets released from the blade surface are coarse, they are less likely to be influenced by the pressing effect by the gas phase. In addition, since the rotor blade turns in a direction in which it is spaced away from the water droplets that have been released from the blade surface, the released water droplets do not are captured again to the pressure side face S2. The water droplets released from the blade surface are washed away to the downstream by the gas phase and carried to the condenser 11 (FIG. 1).

On the other hand, part of water droplets that are not released from the leading edge side protrusion S3 in such a manner as depicted in FIG. 7, although they reach the leading edge side protrusion S3 or the trailing edge side protrusion S4 on the pressure side, are moved toward the blade trailing edge under the guidance of the protrusions. Also the water droplets being moved toward the blade trailing edge in this manner are released from the pressure side face S2 in the proximity of the blade trailing edge without reaching the blade distal end.

Further, part of water droplets that are not released from the leading edge side protrusion S3, although they reach the leading edge side protrusion S3 on the suction side, are moved toward the blade leading edge E3 along the leading edge side protrusion S3 and goes around to the pressure side, whereafter they are guided to the proximity of the blade trailing edge and released from the pressure side face S2.

Advantageous Effect (1) As described hereinabove, in the region on the blade root side with respect to the tie boss 28, coarse water droplets being captured by the suction side face S1 flow back to the upstream side and go around to the pressure side face S2 via the blade leading edge E3. In the flow in the proximity of the leading edge, a velocity component toward the blade distal end is dominant due to the centrifugal force. This similarly applies also to water droplets being captured by the pressure side face S2 in the proximity of the blade leading edge E3. Such movement of water droplets toward the blade distal end on the rotor blade surface consumes the energy of rotation of the rotor blade. Especially, the energy that is consumed to carry water droplets from the root side to the distal end of the rotor blade is high and makes a significant factor of loss of rotor blade work. In addition, in a process in which water droplets are moved on the blade surface, they are coarsened and accelerated such that the speed of them exceeds the rotor blade distal end speed when they reach the rotor blade distal end, and then the water droplets return at a supersonic speed into the flow of steam, whereafter they collide with the diaphragm outer ring 18, seal, and so forth to cause erosion.

According to the present embodiment, water droplets being captured by the region on the blade root side in the proximity of the leading edge can be released from the blade surface at an intermediate portion in the blade length direction by the leading edge side protrusion S3 while they are not permitted to reach the blade distal end. Consequently, the mechanical work of the rotor blade consumed wastefully to feed water droplets from the blade root side with respect to the tie boss 28 to the blade distal end can be reduced, and the energy efficiency of the steam turbine can be improved.

The leading edge side protrusion S3 is provided such that, at this time, it overlaps with the tie boss 28 as viewed from the upstream side in the flowing direction of the steam S. Since the tie boss 28 provided for connection to an adjacent blade does not originally play a role for converting fluid energy of the steam S into mechanical work, by providing the leading edge side protrusion S3 in an overlapping relation with the tie boss 28, the influence of it on the blade performance can be suppressed reasonably. Further, since the range in which the leading edge side protrusion S3 extends is not the entire circumference of the rotor blade but part of the circumference, also increase in the weight of the rotor blade by provision of the protrusion on the blade surface can be suppressed. In addition, although the cross section of the rotor blade is set comparatively thick on the root side thereof, the blade distal end side of the rotor blade across the proximity of the tie boss 28 is made thinner taking the centrifugal force into consideration. By providing the leading edge side protrusion S3 at the thick portion having high strength in the proximity of the tie boss 28, also the change in weight distribution can be suppressed. By suppressing the weight and the change in weight distribution of the rotor blade in this manner, also difficulty in adjustment of the natural frequency of the rotor blade can be avoided.

In this manner, according to the present embodiment, while the influence on the aerodynamic performance of the rotor blade is suppressed, water droplets being moved on the rotor blade surface can be released from the blade surface thereby to improve the turbine efficiency.

(2) As described above, water droplets that are fed from the blade root side to the rotor blade distal end can be released in an coarsened state from the blade distal end and then collide at a high speed with a surrounding structure to cause erosion. It is known that the erosion progresses at the cube of collision speed of water droplets with a target.

According to the present embodiment, water droplets being captured by the root side with respect to the tie boss 28 can be released from the protrusion whose circumferential speed is lower than that of the blade distal end before they reach the blade distal end. Although depending upon the installation position of the protrusion in the blade length direction, there is the possibility that the amount of water droplets to be released from the rotor blade distal end may be reduced to half due to the presence of the protrusion, and also significant suppression of the progress of erosion can be expected.

(3) As described hereinabove, water droplets being captured by the suction side face S1 in the proximity of the leading edge of the rotor blade tends to go around to the pressure side face S2 via the blade leading edge E3 without being moved to the blade trailing edge side. In the present embodiment, by providing the leading edge side protrusion S3 extending from the suction side face S1 to the pressure side face S2 via the blade leading edge E3, water droplets being captured by the suction side face S1 in the proximity of the blade leading edge E3 can be released reasonably at an appropriate position from the blade surface.

(4) Here, if it is assumed that, on the suction side of the rotor blade, the leading edge side protrusion S3 is inclined to the blade distal end side toward the blade trailing edge, then it acts so as to stop the flow of water droplets that tend to go around from the suction side to the pressure side via the blade leading edge. In this case, also after the water droplets reach the leading edge side protrusion S3 on the suction side face S1 in the proximity of the blade leading edge E3, there is the possibility that part of the water droplets remaining on the blade surface may not be guided well to the downstream side.

In contrast, the leading edge side protrusion S3 extends such that the distance of it from the blade root monotonously increases from the start end E1 on the suction side to the terminal end E2 on the pressure side, and is inclined, on the suction side, to the blade distal end side toward the blade leading edge E3. By cooperation of such inclination of the protrusions and the centrifugal force or the shearing force of the gas phase, part of water droplets remaining on the blade surface even after the water droplets reach the leading edge side protrusion S3 on the suction side face S1 in the proximity of the blade leading edge E3 can be guided reasonably and smoothly toward the trailing edge along a route that passes the blade leading edge E3.

(5) If part of fine liquid droplets of the liquid phase of steam S are captured by the pressure side face S2 of the rotor blade by inertial collision and are moved to be coarsened on the pressure side face S2 and then reach the blade distal end passing through the trailing edge side with respect to the tie boss 28, this is also not preferable from the point of view of energy loss and erosion. In contrast, in the present embodiment, the trailing edge side protrusion S4 is provided also in the region of the pressure side face S2 on the blade trailing edge side, particularly in the region on the opposite side to the leading edge side protrusion S3 across the tie boss 28. Consequently, also on the trailing edge side of the tie boss 28, water droplets can be released reasonably at an appropriate position without permitted to reach the blade distal end.

(6) Further, the terminal end of the trailing edge side protrusion S4 is spaced way from the blade trailing edge, and even on the pressure side face S2, a protrusion does not exist in the proximity of the trailing edge. Water droplets in the proximity of the blade trailing edge naturally reach the trailing edge by an action of shearing of the gas phase and so forth without being guided by the protrusion and then are eliminated from the blade surface. Further, the protrusion does not exist also in the region of the suction side face S1 on the trailing edge side with respect to the tie boss 28. Although coarse water droplets can be captured by the suction side face S1 in the proximity of the leading edge as described hereinabove, since such water droplets go around to the pressure side face S2 via the blade leading edge E3, the necessity to form the protrusion in the region of the suction side face S1 on the blade trailing edge side with respect to the tie boss 28 is low. By precisely grasping the flow line of water droplets and limiting the provision region for the protrusion to only appropriate positions in this manner, increase in the weight of the rotor blade and change in the weight distribution by formation of the protrusion can be suppressed reasonably.

(7) The leading edge side protrusion S3 and the trailing edge side protrusion S4 are formed by profile adjustment within a range of the machining allowance of the material. Therefore, there is no necessity to newly prepare a metal die for press work or casting, and the rotor blade having the protrusion can be manufactured using an existing metal die, and the merit also in terms of the manufacturing cost is significant.

(8) In the leading edge side protrusion S3 and the trailing edge side protrusion S4, the width W taken in the blade length direction is smaller than the width of the tie boss 28 in the same direction. In this regard, the leading edge side protrusion S3 and the trailing edge side protrusion S4 are advantageous where they are overlapped with the tie boss 28 as viewed in the flowing direction of the steam S, and the influence of them on the aerodynamic performance of the rotor blade can be suppressed reasonably as described hereinabove. In addition, in the leading edge side protrusion S3 and the trailing edge side protrusion S4, the thickness D taken in the normal direction to the blade surface is set further smaller than the width W, and the cross section of the protrusions is small and thin. As described hereinabove, the cross section has such a size that it can be formed within a range of the machining allowance of the material. Therefore, the leading edge side protrusion S3 and the trailing edge side protrusion S4 have almost no portion that is not viewed in the normal direction to the suction side face S1 or the pressure side face S2 (in FIG. 7, an edge portion of a fillet of the radius R of curvature). Consequently, shot peening can be carried out for a substantially overall area of the blade profile including the leading edge side protrusion S3 and the trailing edge side protrusion S4.

(9) An idea to provide fins on a blade surface of a rotor blade in order to control the flow of the gas phase of steam is generally known. However, fins having such a height as to change the profile of the blade surface (for example, a height equal to or smaller than the machining allowance of the material) do not function from the point of view of guiding a flow of the gas phase, and the fins must be formed so as to project by an appropriate height from the blade surface. In fact, the design of rotor blades in recent years has reached a limit in regard to the strength, and it is difficult to attach highly projecting fins to the blade surface because of the increase in the weight of the rotor blade or the magnitude of a change in the weight distribution of the rotor blade.

In contrast, the unevenness of the protrusion of the present embodiment is sufficient to the extent that it provides to water droplets a change in velocity vector for allowing water droplets to be released from the blade surface, and application of this is permitted also in terms of design conditions. Thus, even where long blades in recent years are targeted, fixed possibility can be assured.

Modifications

Figure 8:
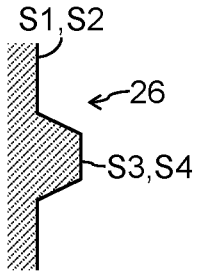
FIG. 8 is a cross sectional view of a protrusion of a steam turbine rotor blade according to a first modification.
Figure 9:
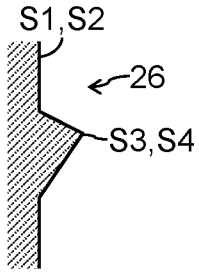
FIG. 9 is a cross sectional view of a protrusion of a steam turbine rotor blade according to a second modification.
Figure 10:
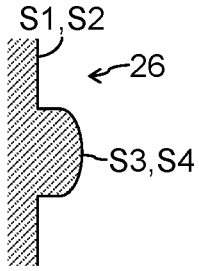
FIG. 10 is a cross sectional view of a protrusion of a steam turbine rotor blade according to a third modification.

FIG. 8 is a cross sectional view of a protrusion of a steam turbine rotor blade according to a first modification;

FIG. 9 is a cross sectional view of a protrusion of a steam turbine rotor blade according to a second modification; and FIG. 10 is a cross sectional view of a protrusion of a steam turbine rotor blade according to a third modification. All of FIGS. 8 to 10 are views corresponding to FIG. 7 of the embodiment described hereinabove. As depicted in FIGS. 8 to 10, for both the leading edge side protrusion S3 and the trailing edge side protrusion S4, the cross sectional shape can be suitably changeably designed. As depicted in FIG. 8, the cross sectional shape of the protrusion can be made a trapezoidal shape in which, for example, the oblique portion is formed from only a straight line and has no fillet (in short, an inclined surface portion is formed from only a flat surface). As depicted in FIG. 9, also it is possible for the cross sectional shape of the protruding blade portion to be made a triangular shape. In this case, although the cross sectional shape may be made an isosceles triangle, also it is possible to make the cross sectional shape of the protruding blade portion having a shape in which the apex angle is offset to the blade distal end side as depicted in FIG. 9. As depicted in FIG. 10, the cross sectional shape of the protrusion can be made a protruding lens shape or an arcuate shape having no edge.

Also it is conceivable to allow water droplets to be released easily from the protrusion by applying water repellent coating to the protrusion.

Further, although FIG. 5 exemplifies a configuration in which the leading edge side protrusion S3 and the trailing edge side protrusion S4 are inclined with respect to the rotation center line C so as to positively guide water droplets to the blade trailing edge, the essential function of the protrusion resides in the draining function of causing water droplets, which reach them, to be released from the blade surface. Accordingly, the protrusion does not necessarily have the function of positively guiding water droplets toward the blade trailing edge, and as viewed on a meridian plane similarly to FIG. 5, for example, the leading edge side protrusion S3 and the trailing edge side protrusion S4 may be extended in parallel to the rotation center line C.

Further, although FIG. 5 exemplifies a configuration in which the leading edge side protrusion S3 and the trailing edge side protrusion S4 are each provided in one row, at least one of the leading edge side protrusion S3 and the trailing edge side protrusion S4 may be provided in a plurality of rows in the blade length direction as long as the strength design of the rotor blade permits. In a case where the leading edge side protrusions S3 and the trailing edge side protrusions S4 are provided in a plurality of rows, it is sufficient if the thickness D of the protrusion is decreased according to the number of rows. In this case, the protrusion in any row preferably overlaps with the tie boss 28 as viewed in the flowing direction of the steam S.

DESCRIPTION OF REFERENCE CHARACTERS

14*a* to 14*d*: Steam turbine rotor blade
28: Tie boss
C: Rotation center line of turbine
D: Thickness of leading edge side protrusion taken in normal direction to blade surface
E1: Start end of leading edge side protrusion
E2: Terminal end of leading edge side protrusion
E3: Blade leading edge
S1: Suction side face
S2: Pressure side face
S3: Leading edge side protrusion
S4: Trailing edge side protrusion
W: Width of leading edge side protrusion taken in blade length direction

What is claimed is:

1. A steam turbine rotor blade having, at an intermediate position in a blade length direction thereof, a tie boss for connection to an adjacent blade, wherein the steam turbine rotor blade includes a leading edge side protrusion that extends in an embankment shape in a blade chord length direction at the intermediate position in the blade length direction, a start end of the leading edge side protrusion is located on a suction side surface and a terminal end of the leading edge side protrusion is located on a pressure side surface, and the leading edge side protrusion continues from the start end to the terminal end via a blade leading edge, and the leading edge side protrusion in the blade length direction overlaps with the tie boss as viewed from an upstream side of the steam turbine rotor blade, wherein the leading edge side protrusion extends such that a distance thereof from a blade root monotonically increases from the start end to the terminal end, a cross sectional shape of the leading edge side protrusion is set to satisfy $2<W/D<100$, wherein the D is a thickness of the leading edge side protrusion taken in a direction normal to a blade surface, the W is a width of the leading edge side protrusion taken in the blade length direction, on a suction side of the rotor blade, the leading edge side protrusion is inclined to an outer side in a radial direction toward the leading edge of the rotor blade, and on a pressure side of the rotor blade, the leading edge side protrusion is inclined to the outer side in the radial direction toward a blade trailing edge.

2. The steam turbine rotor blade according to claim 1, wherein the steam turbine rotor blade further includes a trailing edge side protrusion that is located in an extension direction of the leading edge side protrusion in a trailing edge side region of the pressure side surface, and wherein the tie boss is interposed between the trailing edge side protrusion and the leading edge side protrusion.

3. The steam turbine rotor blade according to claim 2, wherein a terminal end of the trailing edge side protrusion is spaced away from the blade trailing edge.

4. The steam turbine rotor blade according to claim 1, wherein the width of the leading edge side protrusion taken in the blade length direction is smaller than a width of the tie boss taken in the blade length direction.

* * * * *